US005740654A

United States Patent [19]

Manni et al.

[11] Patent Number: 5,740,654

[45] Date of Patent: Apr. 21, 1998

[54] PACKAGING ASSEMBLY FOR FREEZE-DRIED PREPARATIONS

[75] Inventors: Charles Manni, Monaco, Monaco; Jean-Pierre Augier, Nice, France

[73] Assignee: Semco, Monaco, Monaco

[21] Appl. No.: 632,525

[22] Filed: Apr. 12, 1996

[51] Int. Cl.[6] ..... B65B 3/04

[52] U.S. Cl. ..... 53/242; 53/243; 141/329; 141/384; 220/366.1

[58] Field of Search ..... 141/329, 384; 53/239, 242, 243, DIG. 2; 220/366.1; 215/355, 247, 248

[56] References Cited

U.S. PATENT DOCUMENTS

| | | | |
|---|---|---|---|
| 3,773,205 | 11/1973 | Keeler et al. | 53/DIG. 2 |
| 4,573,506 | 3/1986 | Paoletti | 141/329 |
| 4,747,502 | 5/1988 | Luenser | 220/366.1 |
| 4,979,642 | 12/1990 | Thiebaut | 214/247 |
| 4,982,769 | 1/1991 | Fournier et al. | 141/329 |
| 4,986,322 | 1/1991 | Chilbret et al. | 141/329 |
| 5,197,620 | 3/1993 | Gregory | 220/366.1 |

FOREIGN PATENT DOCUMENTS

| | | |
|---|---|---|
| 0138681 A2 | 4/1985 | European Pat. Off. . |
| 1162249 | 8/1969 | United Kingdom . |

*Primary Examiner*—James F. Coan
*Assistant Examiner*—Gene L. Kim
*Attorney, Agent, or Firm*—Donald J. Pagel; Hopkins & Carley

[57] ABSTRACT

Packaging assembly intended for the extemporaneous preparation of suspensions or solutions of a solid active product in a liquid product, the active product having been freeze-dried and being contained in a flask A, and the liquid product being contained in a flask B closed by a dropper (30), a connection member (16) enabling to put in communication the two flasks for the purpose, in a first step, to cause the liquid product to pass from flask B into flask A containing the solid product, then, in a second step, to reverse the assembly and aspirate into flask B the suspension or solution thus formed. Flask A containing the active product is closed by an elastic stopper (10) having a central perforation (12) closed by a perforable operculum (14) which is perforated by the dropper when the flasks are put in communication by means of the connection member. The stopper comprises several lateral recesses (36, 38, 40 and 42), so that, when the freeze-drying step is applied to flask A in which the stopper is partially put in, gas resulting from the freeze-drying escape outside the flask by passing through the lateral recesses.

6 Claims, 2 Drawing Sheets

PACKAGING ASSEMBLY FOR FREEZE-DRIED PREPARATIONS

Figure 1:
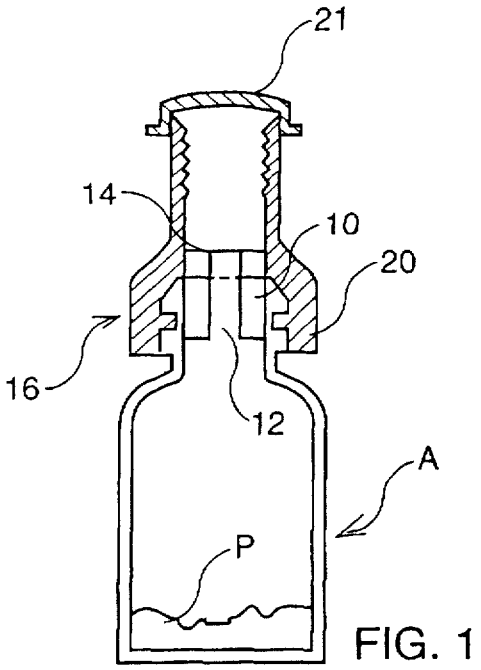

The present invention relates to an improvement in assemblies intended for the extemporaneous preparation of solutions or suspensions of a solid active product, and in particular to an assembly of this type whose the stopper closing the flask containing the active product enables a better efficiency of the active product, as well in quality as in quantity.

Such an assembly is composed in the one hand of two hermetically closed flasks, the first one containing said active product generally in the form of a freeze-dried powder, and the second one containing the liquid in which the active product is put in solution or suspension at the moment of administration, and the other hand of a connection member enabling to establish the communication between these two flasks in two steps during which, first, said liquid is introduced in the first flask, then, the solution or suspension thus formed is aspirated into the second flask.

To that effect, the first flask A is made of glass, and is closed by an elastomer stopper inserted in the neck and having an axial channel. The stopper is covered by a thin, perforable, airtight operculum fixed on the outside face of the stopper, whereas the second flask B made of compressible material is closed by a dropper whose extremity has a diameter slightly smaller than of the axial channel of the stopper. In order to allow the putting in communication of the two flasks, the connection member is first made firmly attached to the first flask by snap-fitting the lower part of the connection member on the neck of the flask. Then, the flask B is screwed in the connection member by means of an outside thread of the cylindrical part of the dropper which fits with the inside thread of the upper part of the connection member. During the screwing, the dropper perforates the operculum on the stopper of the glass flask, while maintaining the airtightness between the two flasks. By compressing the second flask, the liquid is caused to pass into the first flask. By shaking the assembly, a solution or suspension is formed, then, on reversing the assembly and by exerting successive pressures on the second flask, the solution or suspension is caused to return into the second flask where it is easy to shut it up by placing a stopper on the dropper.

Until now, the stoppers used to close the flasks containing the active product are positioned onto the flasks outside the freeze-drying chamber, with the drawback of some coming back moisture which is harmful for the unaltered conservation of the active product.

Besides, another drawback results of the operculum being fixed on the stopper by gluing and therefore the possibility that glue particles migrate into the solution or suspension during the reversal of the flasks and modify the solution or suspension.

Accordingly, the object of the invention is to provide a packaging assembly of the type comprising two flasks put in communication such as described hereabove, but equipped with a stopper having not the above-mentioned drawbacks.

Another object of the invention is to provide a packaging assembly of the above type in which the flasks are closed during the freeze-drying step.

Still another object of the invention is to provide a packaging assembly of the above type in which there is no risk of contamination of the active product during the putting in communication of the two flasks.

Therefore, the invention relates mainly to a packaging assembly intended for the extemporaneous preparation of suspensions or solutions of a solid active product in a liquid product, the active product having been freeze-dried and being contained in a flask A, and the liquid product being contained in a flask B closed by a dropper, a connection member enabling to put in communication the two flasks for the purpose, in a first step, to cause the liquid product to pass from flask B into flask A containing the solid product, then, in a second step, to reverse the assembly and aspirate into flask B the suspension or solution thus formed, flask A containing the active product being closed by a elastomer stopper having a central perforation but normally closed by a perforable operculum fixed on the stopper, the operculum being perforated by the dropper when the flasks are put in communication by means of the connection member. The stopper comprises several lateral recesses, and the freeze-drying step is applied to flask A in which the stopper is partially put in so that gas resulting from the freeze-drying escape outside said flask by passing through said lateral recesses.

According to another characteristic, the invention relates to a packaging assembly such as defined above in which the upper part of the recesses in the stopper is put in communication with the central perforation in order to be able to aspirate into flask B the whole content of suspension or solution formed after the two flasks have been put in communication and reversal of the assembly.

According to still another characteristic, the invention relates to a packaging assembly such as defined above in which the perforable operculum is made of aluminum sealed on said stopper by means of a film made of sealable plastic material.

Figure 2:
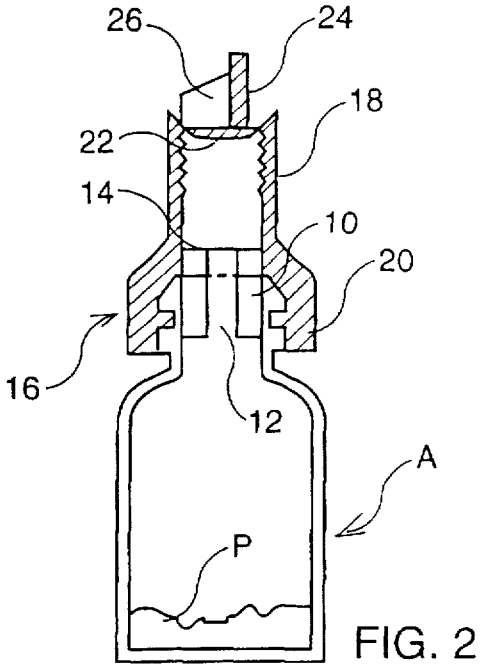
Figure 3:
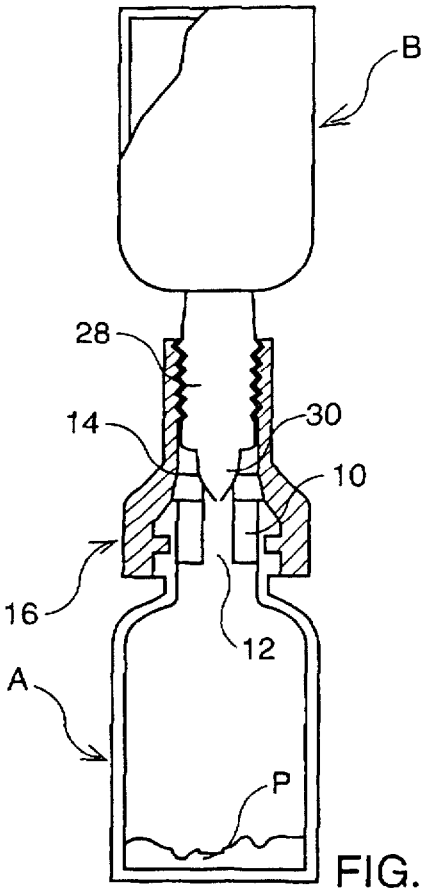
Figure 4:
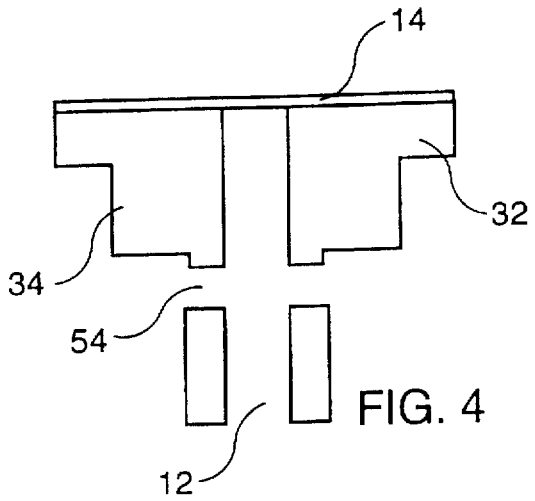
Figure 5:
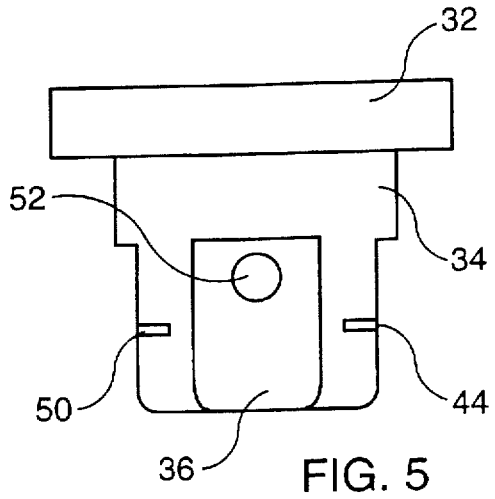
Figure 6:
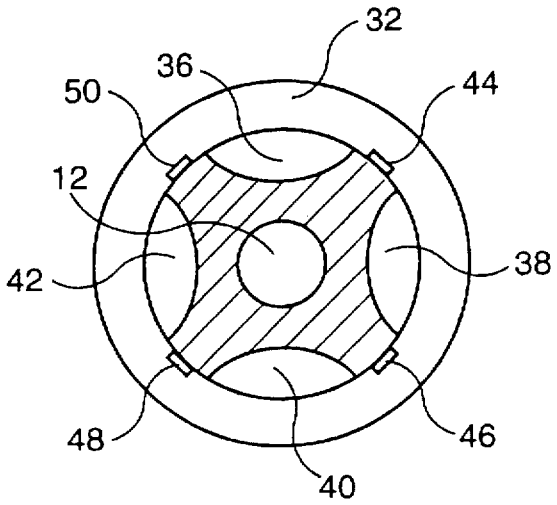

The objects, features and characteristics of the invention will be better defined by reading of the following description with reference to the drawings wherein:

FIG. 1 represents a cross-section of flask A in a prior packaging assembly in which the connection member is provided with an operculum, FIG. 2 represents a cross-section of flask A in a packaging assembly according to the invention in which the connection member is provided with a self-breakable cover, FIG. 3 represents a partial cross-section view of the packaging assembly according to the invention when flask B has been threaded in the connection member in order to put flask A and flask B in communication, FIG. 4 is a cross-section of the stopper closing flask A, FIG. 5 is an elevation view of the stopper closing flask A, and FIG. 6 is a bottom view of the stopper illustrated in FIG. 5, showing the central perforation and the lateral recesses.

Glass flask A containing the active product P and packaged after its freeze-drying step, was presented until now as illustrated in FIG. 1. The active product P can be any type of freeze-dried substance, including pharmaceutical and cosmetic products. As an example of a cosmetic product, the active product P can be collagen. Collagen cannot be preserved in solution without losing its properties and is therefore stored in freeze-dried form in a container such as flask A. The collagen solution is then prepared immediately before use by means of a packaging assembly such as the present invention.

The flask designated by reference A so as to be distinguished from the other flask with reference B, is closed by an elastomer stopper 10 having a vertical perforation 12 and topped by a perforable operculum 14 made of aluminum sealed on stopper 10. Flask A is provided to the customer with a connection member 16 surmounting the neck of flask A and which is used to put flask A in communication with flask B containing the liquid product enabling the active product P to be put in solution or suspension.

Connection member 16 comprises an upper portion 18 in the form of a socket having an inner thread to screw flask B therein, and a lower portion 20 which is fixed on the flask by snap-fitting a shoulder of the flask neck. When the connection member is supplied to the customer, it is stopped by an operculum 21.

At present, and in order to avoid the risk of a possible penetration of impurities in flask A, the top of upper portion 18 of connection member 18 can be closed by a self-breakable cover 22 forming a single moulded piece with the connection member as illustrated in FIG. 2. This self-breakable cover 22 can be easily separated from connection member 16 by a push against an off-centred vertical tab 24 including a strut 26 and connected to the connection member 16 by a thin wall.

To make use of active product P contained in flask A, second flask B is put in communication with flask A as illustrated in FIG. 3.

Flask B made of compressible plastic material and containing the solvent, is reversed and screwed in the upper portion 18 of connection member 16 by means of an outer thread fitting the thread of portion 18.

The cylindrical threaded part 28 includes a dropper 30 as an extension which perforates operculum 14 of stopper 10 in flask A when flask B is screwed in the connection member, putting the two flasks A and B in communication. Then, by compressing flask B, the liquid solvent is caused to pass into flask A. Then, by shaking the assembly, the solution or suspension of the active product is created. Finally, by reversing the assembly and exerting successive pressures on flask B, the solution or suspension is caused to return into flask B which is thus ready for use.

As mentioned above, flask A is freeze-dried before packaging. During this freeze-drying process, it is necessary that the liquid contained in the active product A evaporates to avoid any trace of moisture, which was the case when the antibiotic-type stoppers with their operculum were put in at the output of the freeze-drying chamber in the prior technique. So as to avoid such a risk stopper 10 illustrated in FIG. 4, 5 and 6 has a particular shape as explained below.

The elastomer stopper 10 includes a plate 32 which covers the neck opening of flask A when the stopper is driven in. Plate 32 is covered with an aluminum operculum sealed as described in the following. Part 34 adapted to be inserted in the flask neck is extended with a portion the cross-section of which is illustrated in FIG. 6, that is the elastomer cylinder includes four identical vertical recesses 36, 38, 40 and 42, recess 36 being shown in FIG. 5.

On each of the four portions separating the recesses, there is a stop 44, 46, 48 or 50. At last, as mentioned above, the stopper has a central perforation 12 adapted to put flasks A and B in communication when the dropper has perforated operculum 14.

For the glass flasks containing the active product to be freeze-dried, they are placed in the freeze-drying chamber with the stoppers being already put in the flasks. The stoppers are not completely put in the necks, but only partially, the stops 44, 46, 48 and 50 being supported by the top side of the neck. Therefore, during the freeze-drying step, the gas escape operculum outside the flasks thanks to the four lateral recesses of each stopper. Then, at the end of the freeze-drying step, and always inside the freeze-drying chamber, the stoppers are completely put in by exerting a force at their top which enables the cylindrical full portion 34 to be inserted in the neck.

The stopper closing flask A which has just been described in reference to FIG. 4, 5 and 6, has raised some problems which have been solved within the scope of the present invention.

The first problem which has been solved by this invention is due to the stopper configuration. As seen above, the lateral recesses 36, 38, 40 and 42 are necessary for the freeze-drying step. But, when flask A is put in communication with flask B, resulting in putting the active product contained in flask A in solution or suspension, and then reversal of the assembly, a part of the product can remain in these recesses because the product passes from a flask into the other one through the central hole 12 the input of which is higher than the recesses. This part of product not used is not negligible and represents a loss for the customer.

It is why stopper 10 includes two horizontal holes 52 see (FIG. 5) and 54 (see FIG. 4) putting the recesses in communication with central hole 12. Thus, hole 52 enables recess 36 and recess 40 to communicate with the central hole whereas hole 54 enables recess 38 and recess 42 to communicate with the central hole. In this way, when the liquid obtained by putting the active product of flask A in solution or suspension, passes into flask B, almost the whole liquid flows out and the loss due to the recesses becomes negligible.

A second problem was the fixation of operculum 14 on stopper 10. Indeed, until now, the operculum generally made of aluminum, is fixed on the stopper by glue. This way of doing has two drawbacks. First, during the sterlilization in an autoclave which takes place before the flasks are freeze-dried, there is sometimes unsticking of the operculum due to the softening of the glue caused by the high temperature. Then, when the communication between the two flasks is established, the assembly is reversed for the liquid to return into flask B, the product comes into contact with the glue which is under the operculum at the location of the central hole in the stopper. It has been proved that, in some cases, glue particles could migrate into the solution or suspension and therefore modify the properties thereof.

It is why, according to the invention, the operculum is fixed by sealing it on the stopper. First, sealing of the two materials is performed by using a means for instantaneous softening the polyethylene film in order to have it strongly adhered to the aluminum during the hardening which follows this process. Such a sealing is preferably carried out by pressing the operculum on the stopper and applying ultrasounds to the assembly aluminum-polyethylene, but can be carried out by any other means. The stoppers so closed are then vapor sterilized without any risk of unsticking the polyethylene film. Furthermore, there is no risk of pollution of the solution or suspension of the active product by glue particles during the flask reversal.

We claim:

1. A stopper for insertion in a flask that holds a freeze-dried product comprising:

a top part sized to prevent the top part from being inserted in a neck of a flask that holds a freeze-dried material;

an engagement part that abuts the top part and which is sized to allow it to fit tightly inside the neck of the flask when the stopper is fully inserted in the flask;

a middle part that abuts the engagement part mad which includes a bottom surface that forms an end of the stopper;

at least one stop positioned on the middle part, the stop being sized to remain outside of the flask when the middle part of the stopper is inserted in the flask up to the stop, but which will fit inside the flask when sufficient force is applied to the stopper;

a central passageway which extends through the stopper from the top part to the bottom surface to provide a passageway through which a liquid can enter and exit the flask;

at least one lateral recess formed by the middle part, the lateral recess comprising a passageway that extends along an outside edge of the middle part from the bottom surface up to the engagement part, the passageway providing a space through which a gas can escape from the flask when the middle part of the stopper is inserted in the flask but the engagement part is not; and at least one horizontal aperture which connects at least one lateral recess with the central passageway so that a liquid can flow between the lateral recess and the central passageway.

2. The stopper of claim 1 further comprising: an operculum positioned on top of the top part and that covers the central passageway so that the central passageway is essentially closed to the passage of fluids or gases while the operculum is intact, the operculum being adapted for penetration by an external object so that liquid can be introduced into the central passageway.

3. The stopper of claim 2 wherein the operculum comprises a piece of aluminum attached to the stopper with a film comprised of a plastic material.

4. The stopper of claim 3 wherein the operculum is sealed to the stopper by applying ultrasound to the plastic material.

5. A stopper for insertion in a flask that holds a freeze-dried product comprising:

a top part sized to prevent the top part from being inserted in a neck of a flask that holds a freeze-dried material;

an engagement part that abuts the top part and which is sized to allow it to fit tightly inside the neck of the flask when the stopper is fully inserted in the flask;

a middle part that abuts the engagement part and which includes a bottom surface that forms an end of the stopper;

a central passageway which extends through the stopper from the top part to the bottom surface to provide a passageway through which a liquid can enter and exit the flask;

four lateral recesses symmetrically positioned around the circumference of the middle part, the four lateral recesses each comprising a passageway that extends along an outside edge of the middle part from the bottom surface up to the engagement part, the passageway providing a space through which a gas can escape from the flask when the middle part of the stopper is inserted in the flask but the engagement part is not; and a first horizontal aperture which connects a first pair of the lateral recess with the central passageway so that a liquid can flow between the first pair of lateral recesses and the central passageway.

6. The stopper of claim 5 further comprising:

a second horizontal aperture which connects a second pair of lateral recesses not connected by the first horizontal aperture with the central passageway so that a liquid can flow between the second pair of lateral recesses and the central passageway.

* * * * *